US005669167A

United States Patent [19]

Kemp

[11] Patent Number: 5,669,167

[45] Date of Patent: Sep. 23, 1997

[54] SUSPENDED TRADING CARD HOLDER

[76] Inventor: Lori Ann Kemp, 707 Chestnut Hill Dr., Marietta, Ga. 30064

[21] Appl. No.: 615,684

[22] Filed: Mar. 13, 1996

[51] Int. Cl.[6] ..... G09F 3/18

[52] U.S. Cl. ..... 40/642; 40/706

[58] Field of Search ..... 40/611, 661, 124.4, 40/706, 642; 206/449, 453

[56] References Cited

U.S. PATENT DOCUMENTS

| | | | |
|---|---|---|---|
| 2,736,975 | 3/1956 | Grotthuss | 40/706 |
| 3,681,866 | 8/1972 | Loersch | 40/706 |
| 4,062,140 | 12/1977 | Meyer et al. | 40/706 |
| 4,114,293 | 9/1978 | Quinn, III | 40/661 X |
| 4,467,541 | 8/1984 | Pettersson | 40/706 X |
| 4,497,125 | 2/1985 | Hutchinson | 40/124.4 X |
| 4,980,982 | 1/1991 | Verdon et al. | 40/661 X |
| 5,092,062 | 3/1992 | Palka | 40/124.4 X |
| 5,097,953 | 3/1992 | Gingras | 40/124.4 X |
| 5,320,225 | 6/1994 | Kirkpatrick | 206/449 |
| 5,413,228 | 5/1995 | Le Clerc | 40/124.4 X |
| 5,419,062 | 5/1995 | Polinski et al. | 40/124.4 |

*Primary Examiner*—Joanne Silbermann

*Attorney, Agent, or Firm*—Patent & Trademark Services; Joseph H. McGlynn

[57] ABSTRACT

A trading card holder which can be used to hold all types of trading cards. The holder comprises a bottom plate, which is preferably transparent, provided with a stepped portion over which holders for the top, bottom, and sides of the card are attached. A raised portion in the center holds, and supports the cards to prevent any damage to the cards. A top plate, which is preferably transparent, overlies the bottom plate and a raised portion in the center which cooperates with the raised portion on the top plate to provide protection for the cards while not obscuring the cards.

4 Claims, 1 Drawing Sheet

SUSPENDED TRADING CARD HOLDER

BACKGROUND OF THE INVENTION

This invention relates, in general, to a holder for trading cards, and, in particular, to a holder for trading cards that will preserve and protect the cards.

DESCRIPTION OF THE PRIOR ART

In the prior art various types of holders for sports memorabilia have been proposed. For example, U.S. Pat. No. 4,497,125 discloses a wall display device suitable for displaying record albums which includes a plurality of blocks having upper vertical corner channels to hold the bottom corners of the albums, and vertical side channels to hold the upper corners of the album.

U.S. Pat. No. 5,092,062 discloses a display device which contains a plurality of open topped, card receiving pockets arranged on the front face of a main, plate-like body.

U.S. Pat. No. 5,413,228 discloses a storage rack for holding sports equipment such as baseballs, gloves, bats and trophies.

U.S. Pat. No. 5,419,062 discloses a sports card frame in the shape of an article used in a particular sport. The frame has pockets in a planar surface for holding sports cards in a particular array.

With the advent of the popularity of trading cards there is a need for a card holder that will not only display the cards, but also preserve and protect the cards. Many cards are quite valuable, but only if they are in excellent condition. Since the value of the cards is in direct relationship to the condition of the cards, it is imperative that collectors have a card holder that will protect the cards. One of the most fragile areas is the corners of the cards. The prior art devices mostly use pockets that engage the corners of the cards and, therefore, can possibly damage the cards, thereby reducing their value. In addition, newer cards have colored, metallic foil to make them more attractive. This foil is very thin and therefore very fragile. If the foil is damaged, even slightly, the value of the card will decrease.

SUMMARY OF THE INVENTION

The present invention consists of a trading card holder which can be used to hold all types of sports trading cards. The holder comprises a bottom plate provided with a stepped portion over which holders for the top, bottom, and sides of the card are attached. A raised portion in the center holds, and supports the cards to prevent any damage to the cards. A top plate, which is preferably transparent, overlies the bottom plate and provides protection for the cards while not obscuring the cards.

It is an object of the present invention to provide a trading card holder which will preserve and protect all types of sports trading cards.

It is an object of the present invention to provide a trading card holder which will preserve and protect the fragile corners of trading cards.

It is an object of the present invention to provide a trading card holder which will preserve and protect foil layers on the face of the trading cards.

These and other objects and advantages of the present invention will be fully apparent from the following description, when taken in connection with the annexed drawings.

DESCRIPTION OF THE PREFERRED EMBODIMENT

Figure 1:
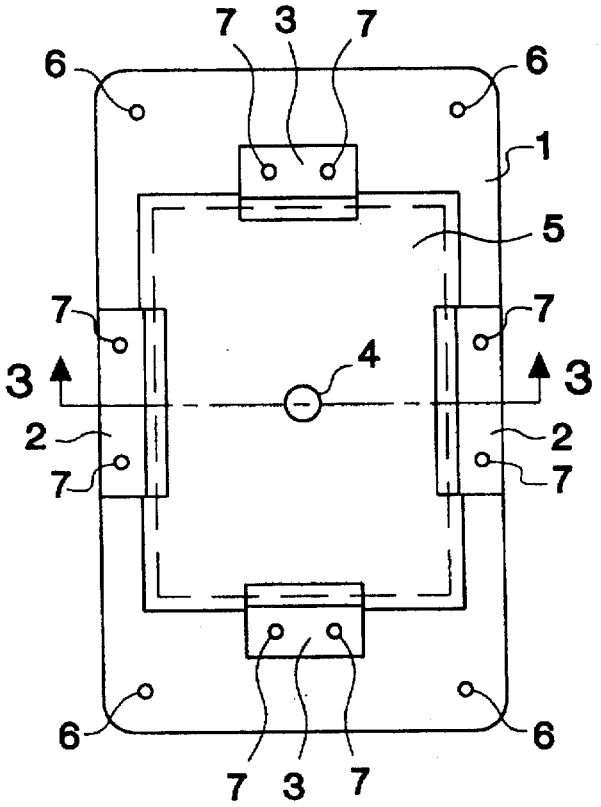
FIG. 1 is a plan view of the bottom plate of the present invention.

Referring now to the drawings in greater detail, FIG. 1 shows the bottom plate 1 which holds any type of trading card 5 (shown in dotted lines in FIG. 1). The bottom plate 1 can be made of any type of material that is strong and relatively rigid, however plastic is the preferred material. In each of the corners of the bottom plate are apertures 6 which will receive a fastener which has been passed through the apertures 10 in the top plate 8 (shown in FIG. 2). Any type of fastener such as, but not limited to, screws which will securely hold the top and bottom plates together can be used.

The bottom plate is provided with two pair of holders 2 and 3 which will securely hold the cards 5 to the bottom plate. The holders, as shown in FIG. 1, are positioned in the middle of the cards, away from the corners which are fragile. If the corners of the cards are damaged, the value of the card decreases. Each of the holders are secured to the bottom plate 1 by means of screws (not shown), or a similar type fastener, which passes through apertures 7 in the holders and then into similar apertures (not shown) in the bottom plate.

Figure 3:
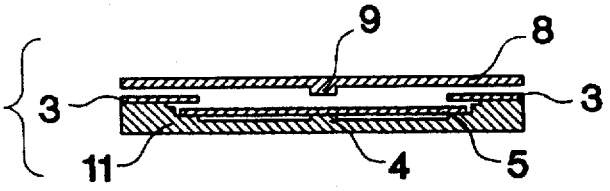
FIG. 3 is a cross-sectional view of the present invention with the top about to be placed on the holder.
Figure 4:
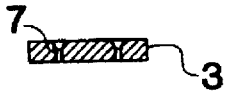
FIG. 4 is a cross-sectional view of one of the holders of the present invention.
Figure 5:
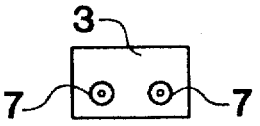
FIGS. 5 and 6 plan views of the holders of the present invention.
Figure 6:
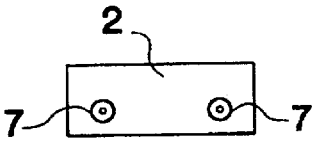

The bottom plate 1, as can be best seen in FIG. 3, has a stepped portion 11 which will support the card 5 along with the raised platform 4 in the center of the bottom plate. Therefore, the cards will be evenly supported so they will not sag, bend or curl over time, which could reduce the value of a card.

Figure 2:
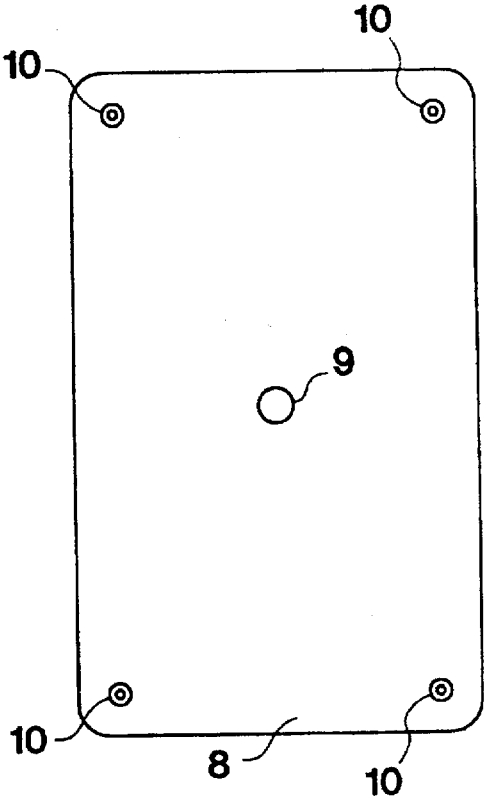
FIG. 2 is a plan view of the top plate of the present invention.

As seen in FIG. 2, the top plate 8 also has a raised platform 9 which is the same as platform 4 on the bottom plate 1. After a card is placed on the bottom plate and secured with the holders 2 and 3, the top plate 8 is secured to the bottom plate by means of fasteners which pass through apertures 10 and then engage the apertures 6 on the bottom plate. The two raised platforms 4 and 9 will securely support the card in the center for the purpose of preventing the card from warping over time. Also, the raised platforms 4 and 9 will space the top plate 8 from the bottom plate 1 which will allow air to circulate within the holder and prevent damage from condensation buildup. The card holder is preferably made from clear plastic, however, other material may be used.

The dimensions of the bottom plate are approximately 5½ inches by 3½ inches by 3/16 of an inch. The dimensions of the top plate are approximately 5½ inches by 3½ inches by 1/16 of an inch. The dimensions of the holders are approximately 1 inch by 21/32 of an inch by 1/16 of an inch, and 1½ inch by 21/32 of an inch by 1/16 of an inch. It should be noted that these dimensions are merely for illustration purposes and the dimensions may vary without departing from the scope of the invention.

Also, even though the holder illustrated is for a single card, it should be noted that the size of the holder could be increased to hold multiple cards without departing from the scope of the invention.

Although the trading card holder and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A holder for trading cards in combination with a trading card, said holder having a top, bottom and sides, said holder comprising:

a bottom plate having stepped portions thereon, said bottom plate having a raised center portion means for engaging only a center portion of said trading card, holding means attached to said bottom plate for holding said trading cards at said top, bottom and sides, said holding means being positioned to engage said trading cards approximately in the center of said top, bottom and sides, a top plate having a raised center portion means for engaging only a center portion of said trading card, said top plate being secured to said bottom plate.

2. The holder as claimed in claim 1, wherein said raised center portions on said top and bottom plates provide a space between said top plate and said bottom plate, whereby air is allowed to circulate between said top plate and said bottom plate.

3. The holder as claimed in claim 1, wherein said holder is made from transparent plastic.

4. The holder for trading cards as claimed in claim 1, wherein said trading cards have a length and a width which form an area, said holding means attached to said bottom plate and said holding means secured to said top plate each have a surface area for engaging said trading card, said areas of said holding means being substantially less than said area of said trading card.

* * * * *